US005349508A

United States Patent [19]

Karbaf

[11] Patent Number: 5,349,508

[45] Date of Patent: Sep. 20, 1994

[54] INTEGRAL HOUSING FOR BALLAST AND FLUORESCENT LAMPS

[75] Inventor: Adam A. Karbaf, Huntington, Ind.

[73] Assignee: Magnetek, Inc., Los Angeles, Calif.

[21] Appl. No.: 88,557

[22] Filed: Jul. 7, 1993

[51] Int. Cl.[5] ..... F21S 3/00

[52] U.S. Cl. ..... 362/217; 362/221; 362/249

[58] Field of Search ..... 362/260, 217, 249, 812, 362/221, 224

[56] References Cited

U.S. PATENT DOCUMENTS

| | | | |
|---|---|---|---|
| 3,134,498 | 5/1964 | Serio et al. | 362/217 |
| 4,161,020 | 7/1979 | Miller | 362/216 |
| 4,435,744 | 3/1984 | Russo | 362/249 |
| 4,811,183 | 3/1989 | Guritz et al. | 362/260 |
| 4,878,159 | 10/1989 | Blaisdell et al. | 362/260 |
| 5,065,292 | 11/1991 | Aubrey | 362/260 |

FOREIGN PATENT DOCUMENTS

| | | | |
|---|---|---|---|
| 151157 | 4/1953 | Australia | 362/217 |

*Primary Examiner*—Carl D. Price
*Assistant Examiner*—Sara Sachie Raab
*Attorney, Agent, or Firm*—Darby & Darby

[57] ABSTRACT

An integral housing for mounting and operating one or more elongated fluorescent lamps. The housing is frame shaped having a center arm with a section for holding the ballast transformer and a side arm at each of the ends of the center arm which have sockets for holding the lamps. The housing is preferably of two hollow sections for holding the ballast, wiring and various components and the sections are fastened together.

5 Claims, 2 Drawing Sheets

INTEGRAL HOUSING FOR BALLAST AND FLUORESCENT LAMPS

BACKGROUND OF THE INVENTION

Various arrangements are provided for mounting and supplying electric current to fluorescent lamps. In a typical arrangement, the ballast transformer, which is used to provide the voltage to the fluorescent lamp or lamps, is mounted separately within a fixture. One or more pairs of sockets are provided at ends of the fixture so that the lamp or lamps can be mounted on the sockets. Leads extend within the fixture from the ballast to the sockets. Such arrangements of ballasts and sockets mounted in a fixture are conventional for relatively large size fluorescent lamps, e.g., 20 watts, 40 watts and above.

Recently, there has been a movement to adopt and use fluorescent lamps of lower wattage capacity, e.g., 1–4 watts, 8 watts and 13 watts. Such low wattage lamps, since they have a relatively small length, have been used in a variety of applications. For example, they are used directly to replace incandescent lamps. In this application the fluorescent lamp, or lamps, are directly mounted in a base which includes the ballast.

One application in which such low wattage lamps can be used is for warning signs. Various types of signs, such as EXIT signs, are required by many governmental regulations as being mandatory in various public places such as schools, hotels, offices, factories, etc. These signs are required to be illuminated by internal or external light sources on a continuous basis, 24 hours a day. In many instances, the majority of the signs are lit by two incandescent lamps, these being rated in the 10–20 watt range for a total of 20–40 watts per sign.

Due to increasing energy costs it is desirable to replace signs using incandescent lamps with fluorescent lamps. Also, incandescent lamps have, as compared to fluorescent lamps, a relatively short life and require replacement. This also increases overall operating costs, which provides a further reason for their replacement. The replacement can be accomplished by providing a fluorescent lamp retrofit kit or provide new signs using fluorescent lamps. In either case, the fluorescent lamps use less energy while providing relatively the same amount of light.

BRIEF DESCRIPTION OF THE INVENTION

The present invention relates to a housing which is an integral mounting for one or more fluorescent lamps as well as the ballast for such lamp or lamps. The housing has a frame shape with a central arm which houses a ballast. Extending from the central arm is a pair of side arms having a socket at each end thereof to accept and hold an end of a fluorescent lamp. Where the housing is to accommodate a pair of lamps, the frame is generally H-shaped with a fluorescent lamp being located at the upper and lower ends of the side arms of the H and the ballast located in the center arm. The H-shaped housing is easily mountable with the sign casing, which can be any type of box having the sign display on one of its sides.

OBJECTS OF THE INVENTION

It is an object of the invention to provide a housing which provides an integral mount for a ballast and one or more fluorescent lamps.

Another object is to provide a housing for one or more fluorescent lamps having a frame with a center arm in which a ballast transformer is mounted and a side arm at each end of the center arm each containing a socket into which an end of the fluorescent lamp is inserted.

A further object is to provide an integral housing for a ballast transformer and a pair of fluorescent lamps in which the housing has the general form of an H-shaped frame with the ballast being located in the center arm and sockets for the lamps at each end of the side arms of the frame.

Yet another object is to provide a housing for integral mounting of a ballast transformer and a pair of fluorescent lamps which is readily adaptable to be used in a warning sign casing.

An additional object is to provide a housing for integral mounting of the ballast and sockets for a pair of low wattage fluorescent lamps of relatively short length.

BRIEF DESCRIPTION OF THE DRAWINGS

Other objects and advantages of the present invention will become more apparent upon reference to the following specification and annexed drawings in which.

DETAILED DESCRIPTION OF THE INVENTION

Figure 1:
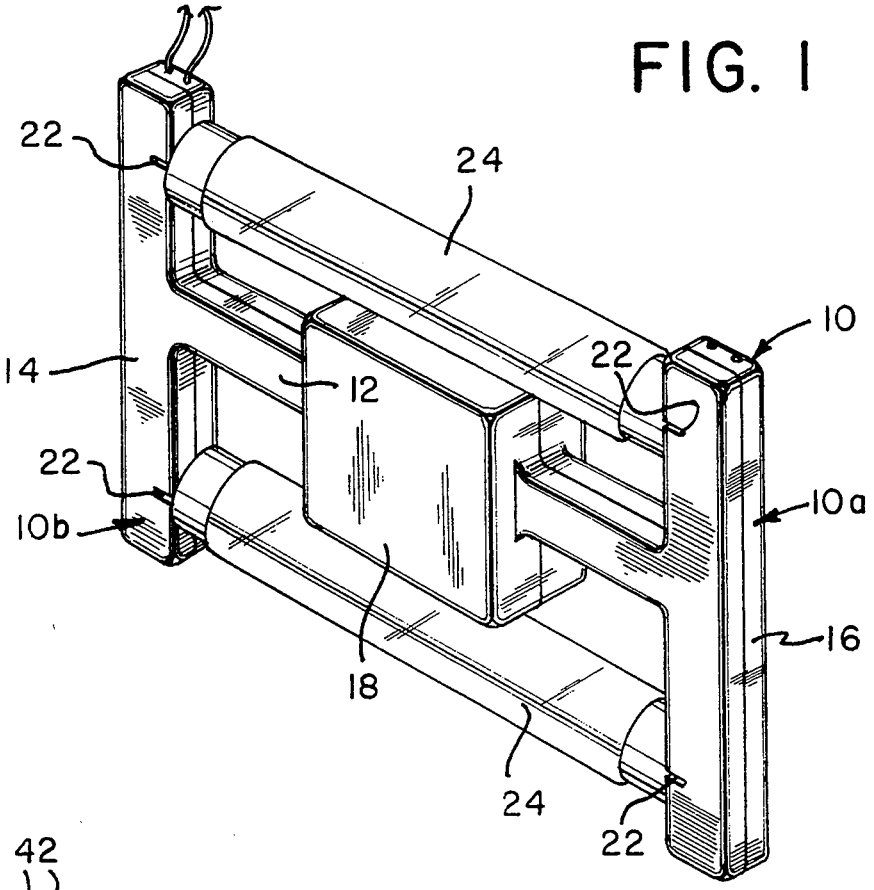
FIG. 1 is a perspective view of the integral ballast and lamp housing in accordance with a preferred embodiment of the invention.

Referring to the drawings, the integral housing 10 is in the shape of a frame having a center arm 12 and side arms 14 and 16 in the general form of an H. Located on the center arm 12 is a section 18 which is larger than the width of the rest of the center arm 12 and extends upwardly toward the ends of the side arms 14, 16. The ballast transformer is located within section 18. The housing 10 is formed by two hollow sections **10*a*, 10*b*** which are fastened together. The hollow sections accommodate the ballast, sockets, wiring and other components of the unit.

As seen in FIG. 1, mounted at each of the upper and lower ends of the side arms 14, 16 of the H is a lamp socket 22. A fluorescent lamp 24 of any desired wattage, but in the preferred embodiment of the invention of a relatively low wattage such as 3–10 watts, is mounted between each pair of sockets 22 at the opposing ends of the side arms 14, 16. These lamps have a relatively short length.

As can be seen in FIG. 1, the housing 10 provides a relatively compact arrangement for both the ballast, which is located within the housing section 18, and the fluorescent lamps 24 on an integral basis. That is, all of the components need to mount and operate two fluorescent lamps are part of the H-shaped frame housing 10.

The sections **10*a*, 10*b*** can be made in any suitable way of any suitable material, for example, a molded plastic. The particular type of plastic depends upon the place where the housing is to be used. For exampled plastics can be selected which are compatible with indoor or outdoor use.

Figure 2:
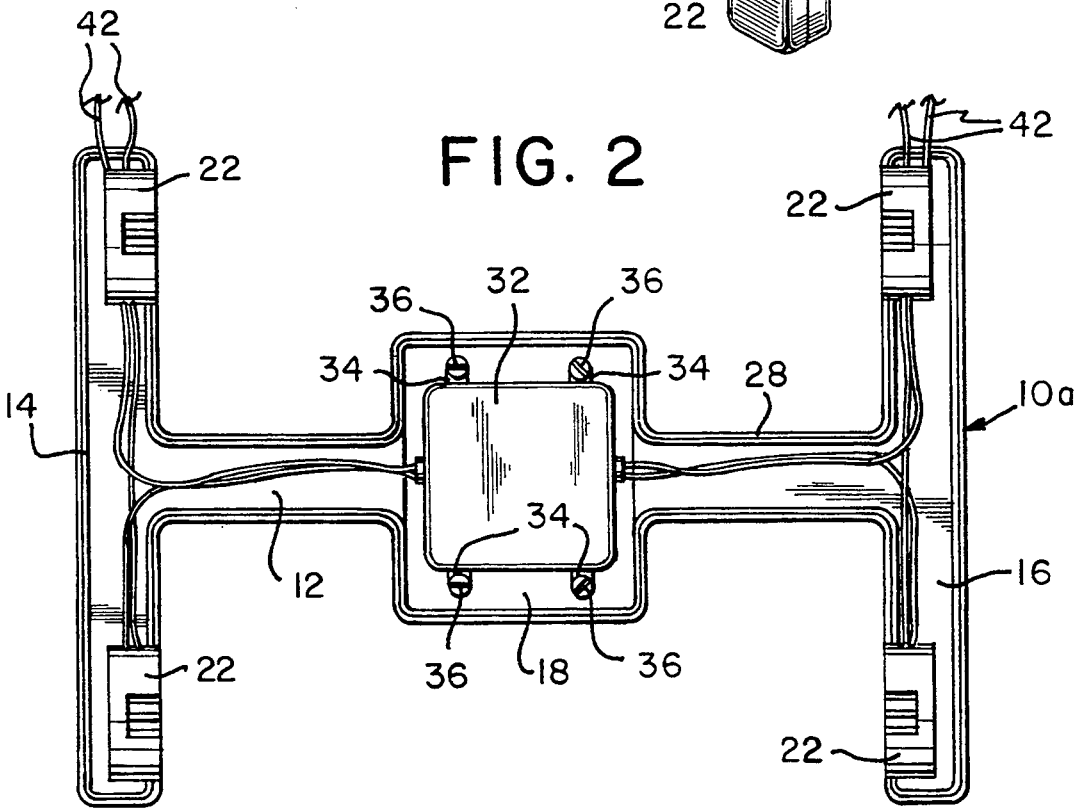
FIG. 2 is a plan view showing the inside of one of the sections of the housing.

FIG. 2 shows the inside of one of the housing sections **10*a*. As seen in FIG. 2, each of the center and side arms 12, 14 and 16 is hollow to accommodate various components. Section 10***b* is essentially a mirror image of section 10*a*. A peripheral wall 28 extends around the arms of the entire section 10*a*. The two sections 10*a*, 10*b* are fastened together, preferably in a permanent arrangement to provide the complete housing 10 as shown in FIG. 1. This is accomplished by providing the peripheral extending walls 28 on each section with a snap or force-type fit, using ultrasonic welding, a suitable adhesive, etc. If desired, the two sections 10*a*, 10*b* can be fastened together with a hinge type arrangement so that the sections can be separated to permit repair or replacement of any internal components.

As seen in FIG. 2, a ballast transformer 32 is mounted within the enlarged section 18 on the center arm 12. The ballast 32 is of a size necessary to operate the two lamps 24. It can be of open frame construction, i.e., the coil is exposed, or it also can be within its own housing of plastic or metal. The ballast transformer 32 is mounted within the housing section 18 by any suitable arrangement, e.g., a snap fit on tabs which are molded within the housing side wall. Alternatively, as shown in FIG. 2, tabs 34 are provided on the ballast 32 and mounted by screws 36 into threaded holes or studs (not shown) which are formed on the inner wall of housing section 18. Of course, any suitable fastening arrangement can be used.

A socket 22 for the terminals at the end of a fluorescent lamp is mounted at each of the ends of the side arms 14, 16. A complete socket 22 is mounted at the end of each of the side arms 14, 16 in section 10*a*. The sockets are covered when section 10*b* is fastened to section 10*a* and the socket contacts are accessible to the lamp 24.

Wires 42 extend within the housing arms 12, 14, 16 from the ballast transformer 32 to the sockets 22 to make the necessary connection. Wires also extend through the openings at the end of one of the arm sections, shown as 14 in FIGS. 1 and 2, for connecting the ballast 32 to the power source. While one ballast transformer 32 has been shown in FIG. 2 for operating two lamps, it should be understood that two separate ballast transformers can be used, one for each lamp. In this case, both ballasts could be in the enlarged section 18, or there can be two enlarged sections. Also, the ballasts can be made small enough to fit within the center arm 16 without any enlargement of the arm.

Figure 3:
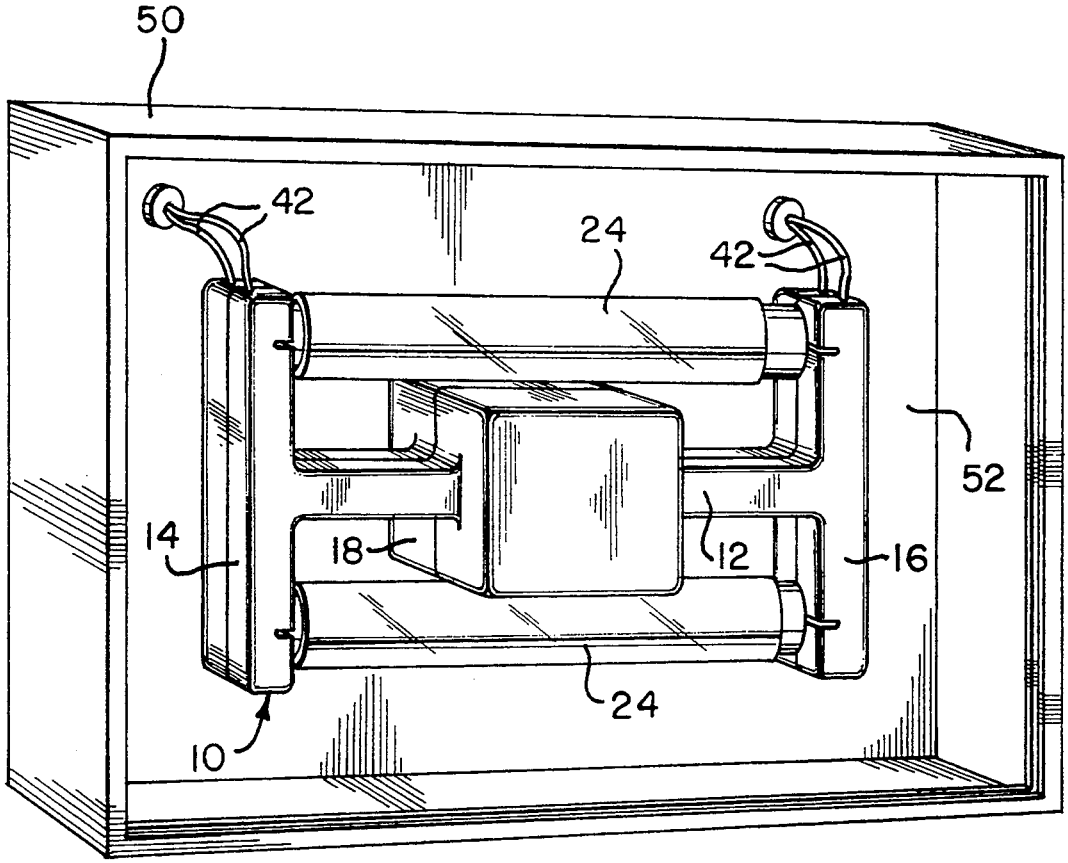
FIG. 3 is a perspective view showing the housing located within the outer casing of a warning sign.

FIG. 3 shows the housing 10 with the fluorescent lamps 24 thereon mounted in a sign casing 50 of any suitable construction and material. As can be seen, the housing 10 is attached to the back wall 52 of the casing 50. This can be accomplished by any suitable arrangement, e.g., screws, snap fit, etc. Not shown is the front part of the casing 50 which includes the sign message, e.g., EXIT. The casing 50 is mounted on a wall or can be hung from a suitable fixture. As can be seen, the housing 10 provides a compact integral arrangement for mounting in the sign casing 50. It is easy to replace either or both of the lamps 24 or the entire housing 10.

While an H shaped mount 10 has been shown as the preferred embodiment, it should be understood that the same arrangement can be used for a single fluorescent lamp. In this case, the mount 10 would have a C-shape, i.e., the upper portion of each of the side arms 14 and 16 would not be present and only a single lamp 24 would be used. If more than two lamps are to be used, the length of side arms 14, 16 would be extended and additional sockets 22 would be placed between the center arm 12 and the ends of the side arms 14, 16.

I claim:

1. A fixture for a pair of fluorescent lamps comprising:

a housing of two complementary mating hollow sections each having a center arm and a side arm extending transversely from each end therefor to form a generally H shape, said center arm having at least a portion which is enlarged relative to said side arms, means for holding said sections together, a ballast transformer within the enlarged portion of said center arm of said sections, a socket for accepting the terminal of a fluorescent lamp adjacent each end of each side arm to hold a fluorescent lamp both above and below said center arm between said side arms and spaced from said center arm, and wiring for the fixture extending between said ballast transformer and said sockets within said housing sections.

2. A fixture as in claim 1 wherein said housing sections are of molded plastic material.

3. A fixture as in claim 1 wherein said sockets are located in said side arms inwardly of the ends of the side arms to place at least a part of each of the lamps inwardly of the ends of the side arms.

4. A fixture as in claim 3 wherein the sockets are located on said housing side arms at positions such that the entirety of each of said lamps is located inwardly of the ends of the side arms and within the overall confines of the housing.

5. A fixture as in claim 1 wherein the outer faces of said housing sections are generally planar.

* * * * *